United States Patent [19]

Komandure

[11] 4,286,568

[45] Sep. 1, 1981

[54] TOOL FOR TRUEING AND DRESSING A GRINDING WHEEL

[75] Inventor: Rangachary Komandure, Schenectady, N.Y.

[73] Assignee: General Electric Company, Schenectady, N.Y.

[21] Appl. No.: 78,941

[22] Filed: Sep. 26, 1979

[51] Int. Cl.[3] ..... B24B 53/12

[52] U.S. Cl. ..... 125/11 R; 125/39; 407/118

[58] Field of Search ..... 125/11 R, 39; 407/117, 407/118

[56] References Cited

U.S. PATENT DOCUMENTS

| | | | |
|---|---|---|---|
| 2,509,922 | 4/1950 | Bura | 407/117 |
| 3,576,200 | 4/1971 | Elmes | 407/118 |
| 3,898,772 | 8/1975 | Sawlek | 125/39 |

OTHER PUBLICATIONS

"Analysis of Positive Rake Dressing", Frank R. Skinner, 9 pages, dated prior to Aug. 28, 1978.

*Primary Examiner*—Harold D. Whitehead

*Attorney, Agent, or Firm*—Leo I. MaLossi; James C. Davis, Jr.

[57] ABSTRACT

A grinding wheel dressing tool having a dressing edge consisting essentially of a side dressing edge angle ranging between 30° and 75° wherein the side dressing edge is at least about 0.5 millimeter in length, an end dressing edge angle between 5° and 30° wherein the end dressing edge is at least about 0.5 millimeter in length, and a straight secondary dressing edge of at least 1 millimeter in length joining the side and end dressing edges, said dressing edge having a lip angle ranging from 90° to 120°, and engaging the periphery of a rotating grinding wheel with said dressing tool at a negative side rake angle ranging from −5° to −35°.

5 Claims, 9 Drawing Figures

TOOL FOR TRUEING AND DRESSING A GRINDING WHEEL

This invention relates to trueing and dressing grinding wheels and to a novel dressing tool of a particular configuration.

As set forth in Oberg et al., *Machinery's Handbook*, p. 1991 (20th Ed., 1976): "The perfect grinding wheel operation under ideal conditions will be self sharpening; i.e., as the abrasive grains become dull, they will tend to fracture and be dislodged from the wheel by the grinding forces, therey exposing, new, sharp abrasive grains. While in precision machine grinding this ideal may be partially attained in some instances, it is almost never attained completely. Usually, the grinding wheel must be dressed and trued after mounting on the precision grinding machine spindle and periodically thereafter. Trueing is a dressing operation wherein, i.e., the face of the wheel is made parallel to the spindle or made into a radius or special shape. Dressing is a more precise operation and may be defined as any operation performed on the face of a grinding wheel that improves its cutting action."

Opening is another dressing operation and refers to the breaking away of the bond material from around the abrasive particles in a wheel thereby exposing them for grinding. A new wheel is initially opened and may have to be periodically opened thereafter to expose new particles when the previously exposed particles have been dislodged or dulled and to remove grinding swarf, which may accumulate during grinding, from around the abrasive particles.

A table of a dressing tool (rake face) is the tool surface against which chips of the grinding wheel bear as they are being severed.

Rake angle refers to the angle of engagement of a dressing tool with a wheel as measured from the tool table as a plane of reference. Side rake angle is defined herein as the angle measured in a plane perpendicular to the wheel spindle which is formed between the table of the tool and a line originating at the center axis of the wheel and extending radially outward through the line or point of intersection of the wheel surface and said table of the tool tip. Side rake angles are considered to be positive when measured in the direction of wheel rotation from the extension of the grinding wheel radius. (That is, by reference to FIG. 2 herein, the angle is negative and positive when the extension of the radius is "below" and "above" the radius, respectively.)

Back rake angle is defined herein as the angle measured in a plane parallel to the wheel spindle which is formed between a table of the tool tip and a line parallel to the wheel spindle. Back rake angles are considered to be positive when measured from a line parallel to the table in a clockwise direction—assuming a left to right tool feed and a clockwise wheel rotation.

Side dressing edge angle is defined as the angle between the leading side of the dressing tool (i.e., the right side assuming left to right tool feed) and a plane parallel to the axis of the tool shank.

End dressing edge angle is defined as the angle between the trailing edge of the dressing tool (i.e., the left side of the dressing tool assuming left to right tool feed) and a plane perpendicular to the axis of the dresser shank.

Lip angle is defined as the angle between the rake face and the clearance face of a dresser. The higher this angle is, the stronger the dresser edge and larger the area close to the dresser tip for rapid heat dissipation. To keep the rake face under compression, during dressing, a lip angle of at least 90° is required. This value becomes very critical especially with hard brittle dresser materials such as diamond, CBN, etc. FIGS. 5, 6 and 7 are schematics showing the effect of combined rake and lip angles on the ability to keep the rake face during dressing either in compression or in tension depending upon the lip angle being greater and equal to or less than 90°, respectively. In the present invention, the lip angle of the dresser tool ranges from 90° to about 120°.

Nose angle is defined as the angle between the side and end dressing (cutting) edges of a dresser. From the point of strength of the dresser tip and also from the point of rapid heat dissipation from the dresser tip, during dressing, larger nose angles are recommended. In the present invention, the side and end dressing edges are joined by a third straight secondary dressing edge. Consequently there will be two nose angles one between the side dressing edge and the secondary dressing edge and the other between the end dressing edge and the secondary dressing edge. Depending upon the type of grinding application, these two angles can be different, although in applications of transverse feed towards and away from the grinding wheel, it may be convenient to provide the same nose angles to the dresser. In the present invention, the nose angle ranges from about 120° to 165°.

Reference can be made to the aforementioned *Machinery's Handbook*, pp, 1992 to 1994 for a listing of commonly used dressing tools and methods for their use. One common type is a single point diamond tool having a granular shaped diamond mounted at one end of a tool shank. (See FIGS. 1, 1A herein.) Dressing is performed with such a tool by engaging the periphery of a rotating wheel with the cylindrical handle of the tool disposed at an angle of 10° to 15° relative to a line drawn perpendicular to a tangent to the wheel periphery at the point of engagement of the tool within the wheel. This is equivalent to a negative side rake angle of about −55° to −60°. (The side rake angle of a single point diamond tool is not easily defined and measured in terms of a face of the diamond tip because of the irregular shape of the tip which varies from one tip to another.) The tool is also occasionally rotated about its longitudinal axis to prolong diamond life by limiting the extent of the wear facets and also to produce a pyramidal shape of the diamond tip. Advantage is taken of the easy cleavage fracture feature of the diamond on the octahedral [111] planes. Unfortunately, the low included angle between the octahedral planes (about 70°) makes the tip extremely weak against mechanical and thermal stresses during dressing and results in a clearance angle far higher (about +45° to 50°) than required and presents to the grinding wheel an extremely large negative rake angle (−55° to −60°) (See FIG. 1A herein) which is an inefficient method of material removal.

Another dressing tool which has been recently developed is a tool comprised of a cylindrical tool shank with a composite diamond compact tip composed of a diamond compact bonded to a carbide substrate fixed at one end. The diamond and carbide layers are oriented parallel to the longitudinal axis of the tool shank. Such composite compacts have been used to dress a grinding wheel by engaging the periphery of the wheel to an exposed edge of the compact with the edge transverse to the diamond layer. The tool is disposed at a positive side rake angle and a lip angle significantly less than 90°.

While the prior methods for dressing are generally considered to be satisfactory, manufacturers are always concerned with improving the grinding process, such as by improving wheel life, surface finish on the workpiece produced by the grinding wheel, dressing tool life and dressing speeds.

Accordingly, it is an object of this invention to provide a dressing tool which enhances the grinding process in these areas.

Another object of this invention is to provide an improved dressing tool with a greatly increased dresser life.

Another object of this invention is to provide a better tool for dressing so as to decrease the grinding cycle time.

Another object of this invention is to provide a more reliable dressing tool where the tip of the dresser is used as a gage (reference) for automatic dimensional control of the work material during grinding.

Another object of this invention is to provide a more economical dressing tool.

Another object of this invention is to provide a tool for dressing a grinding wheel, that yields a superior finish, better accuracy and less part to part variation of the finished dimension of the ground surface.

Another object of this invention is to provide an improved composite compact dressing tool particularly applicable for dressing at a low negative rake angle and having a lip angle of at least 90° and a side and end dressing edge meeting with a straight secondary dressing edge.

SUMMARY OF THE INVENTION

These and other objects are accomplished by the present dressing method.

Briefly stated, the present method comprises providing a dressing tool having a dressing edge consisting essentially of a side dressing edge angle ranging between 30° and 75° wherein the side dressing edge is at least about 0.5 millimeter in length, an end dressing edge angle ranging between 5° and 30° wherein the end dressing edge is at least about 0.5 millimeter in length, and a straight secondary dressing edge of at least 1 millimeter in length joining the side and end dressing edges, said dressing edge having a lip angle ranging from 90° to 120°, and engaging the periphery of a rotating grinding wheel with said dressing tool at a negative side rake angle ranging from −5° to −35°.

For a number of applications, the side dressing edge angle preferably is equal to 90° minus the value of the end dressing edge angle. Preferably, for certain applications the tool also may be disposed at a negative back rake angle ranging from −5° to −35°. The disposition of the tool at the present low negative side rake angle and with a lip angle of at least 90°, i.e. 90° to 120°, enables the rake face to be in compression and prevents chipping of the dresser edge and increases the life of the dresser. This is especially important in the case of hard, brittle abrasive materials such as diamond and CBN, used in dressers, as they are weak in tension and extremely strong in compression. Such a configuration also increases the heat dissipation area at the dresser edge and reduces the wear of the dresser due to high temperature effects (such as graphitization, oxidation, etc.) which are so critical to dresser life.

BRIEF DESCRIPTION OF THE DRAWINGS

FIG. 5 shows downward dressing force 71 directed away from the clearance face 72 and the shaded area 73 representing the portion of the tool in compression.

FIG. 6 shows part of the downward dressing force 76 passing through the clearance face 77 and the shaded area 78 representing the portion of the tool in tension.

Referring to FIGS. 1 and 1A, a prior art method of dressing is shown. A wheel 11 is rotated in a clockwise direction and is dressed by engaging, with the periphery of wheel 11, a dressing tool 13 disposed at a tool hand angle, (measured between the longitudinal axis of the tool handle and line perpendicular to the tangent to the point of contact between the tool 13 and wheel 11), preferably between 10° and 15°. The tool is also canted at about the same angle in the direction of crossfeed (transverse to the wheel surface in a direction parallel to the axis of wheel rotation). In accordance with the aforementioned *Machinery's Handbook*, p. 1995, the depth of cut should not exceed 0.0254 millimeter per pass for general work and should be reduced to 0.00508 to 0.01016 millimeter per pass for a wheel with fine grains used for finishing work; the speed of rotation of the grinding wheel during dressing should be at the recommended grinding rate; and, for example, the crossfeed per wheel revolution for a wheel with a grain size of 50 is 0.188 to 0.305 millimeter.

Referring to FIGS. 2, 3, 4 and 4A, the dressing or trueing method as well as the novel dressing tool in accordance with this invention is shown. A wheel 17 is rotated at grinding speed and is dressed by engaging, with the wheel periphery 19, the present dressing tool 21 disposed at the present low negative side rake angle.

Figure 1:
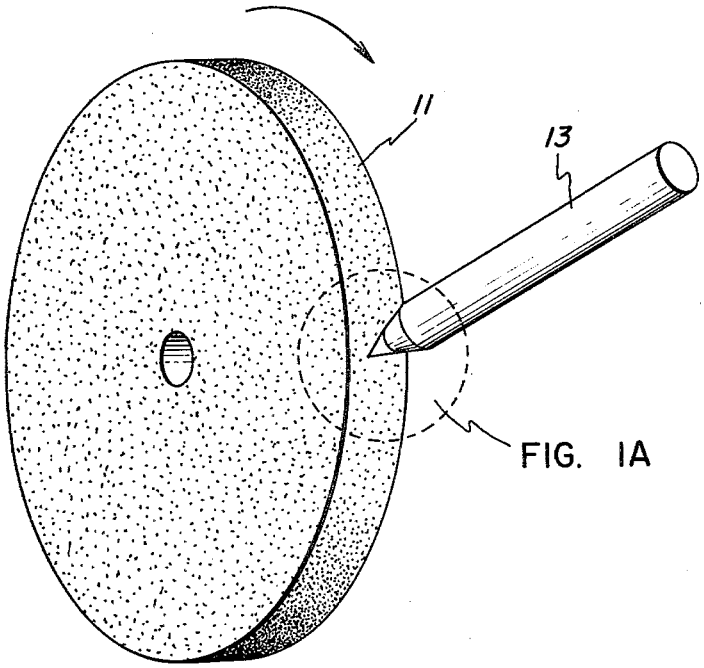
FIG. 1 is a schematic diagram of a prior art method for dressing a grinding wheel with a single point diamond tool, having an extremely large (−55° to −60°) negative side rake angle and an extremely high clearance angle (50° to 60°).
Figure 1A:
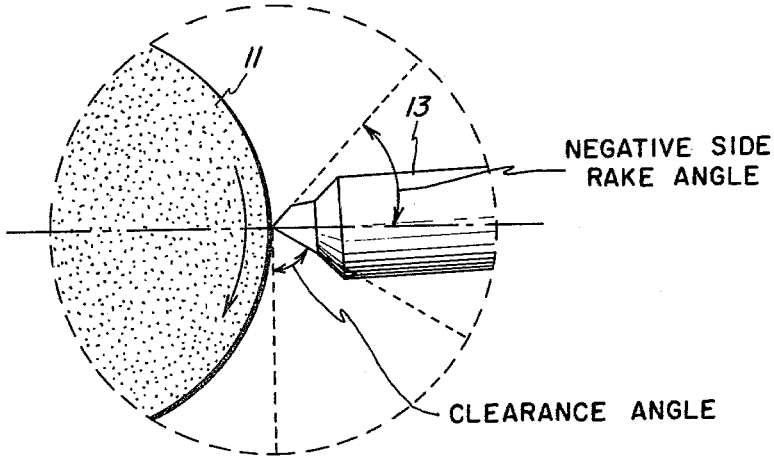
FIG. 1A is an enlarged schematic diagram of a portion of FIG. 1.

In one embodiment the dressing tool 21 used in the present invention is comprised of a tool shank 23 and a composite compact 25 mounted at one end of shank 23. Composite compact 25 comprises a layer 27 of bonded abrasive crystals and a supporting substrate 29 preferably of cemented tungsten carbide coextensive with and bonded to layer 27. The abrasive layer 27 is a polycrystalline compact wherein the crystals are selected from the group consisting of diamond, cubic boron nitride (CBN), wurtzite boron nitride (WBN) and mixtures thereof.

Figure 2:
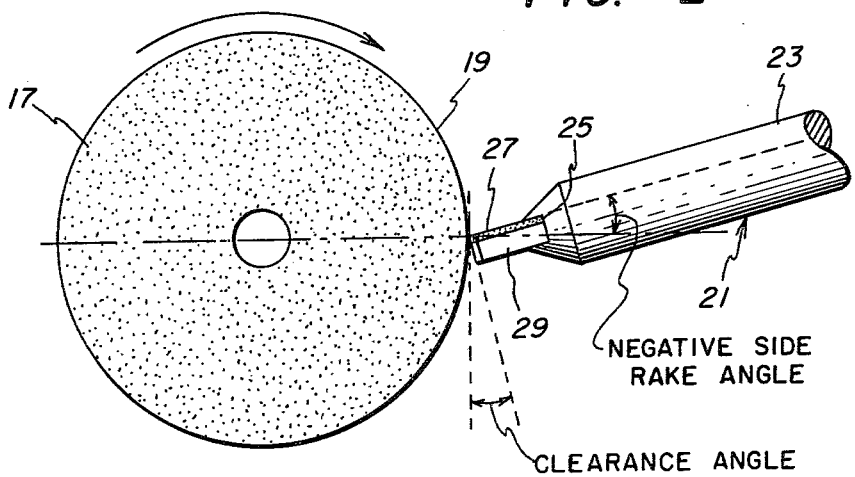
FIG. 2 is a schematic diagram of a dressing method in accordance with the present invention.
Figure 3:
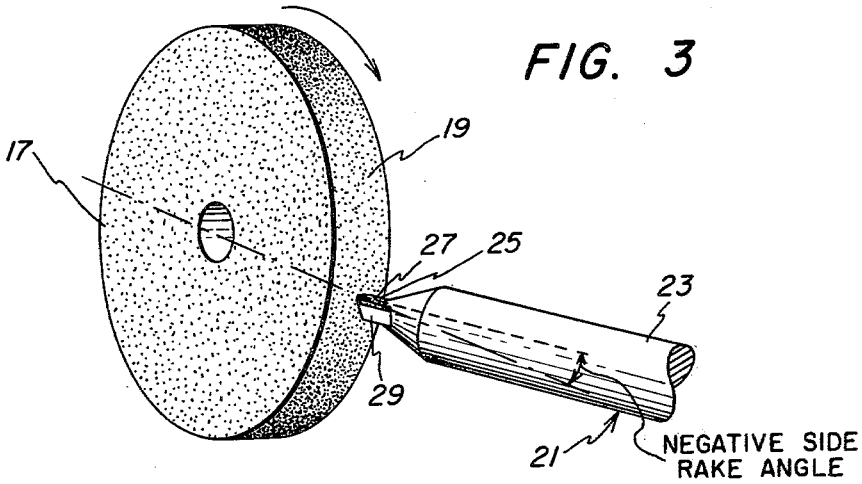
FIG. 3 is an isometric view of FIG. 2 illustrating again the dressing method in accordance with the present invention.
Figure 4:
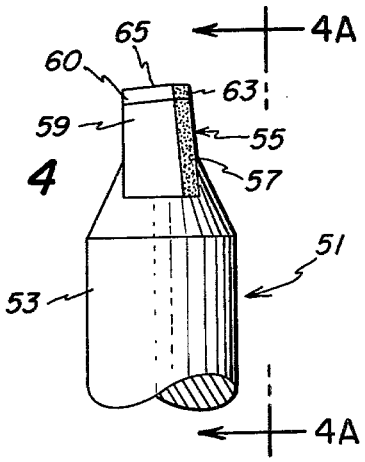
FIG. 4 is a side elevational view of the dressing tool in accordance with the present invention.
Figure 4A:
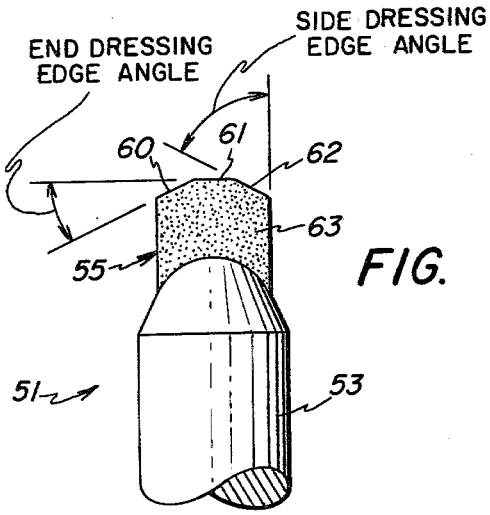
FIG. 4A is a plan view of the dressing tool of FIG. 4 viewed along lines 4A—4A.

The dressing tool or dresser 51 is comprised of a shank 53 and a composite compact 55 mounted at one end of shank 53. Composite compact 55, which may be of identical construction to composite compact 25 (FIGS. 2 and 3) includes a polycrystalline layer 57 of bonded abrasive crystals and a laminar substrate 59, preferably of cemented carbide, bonded to layer 57. Composite compact 55 of tool 51 is provided with a side dressing edge 62 defining a side cutting edge angle as shown in FIG. 4A, and an end dressing edge 60 defining an end dressing edge angle as shown in FIG. 4A. The straight secondary edge 61, which joins the side and end dressing edges, is defined by rake face 63 and clearance face 65.

The fabrication and shaping of composite compact 55 of dressing tool 51 may be formed on an originally rectangular blank in any conventional manner such as by grinding. Edge 61 may be rounded off also in any conventional manner such as by honing with diamond.

The primary (coarse) dressing action of tool 21 or 51 is provided by the side dressing edge 62 and the secondary (fine) dressing action by the linear dressing edge 61 defined by the straight edge joining the side dressing edge 62 and the end dressing edge 60. Since layer 27, i.e. the polycrystalline compact of the present invention is harder and more abrasion resistant than layer 29, i.e. the supporting substrate, layer 27 is positioned to face in a direction opposing wheel rotation. Clearance face 65 which faces the periphery of the grinding wheel is inclined relative to rake face 63 at the lip angle. The linear straight dressing edge 61 is disposed substantially flush with the periphery 19 during dressing or trueing.

The present invention provides significantly freer cutting and a significantly more accurately dimensioned wheel surface compared to that of prior art methods. Rather than dull, flat grits the compact dressing tool fractures the abrasive grains of the wheel to leave many fine cutting edges and sharp points. This produces an improved surface finish on workpieces ground with a wheel dressed in accordance with this invention.

Specifically, wheel 17 is rotated at grinding speed and is dressed or trued by engaging with the wheel periphery 19 the present dressing tool 21 or 51 disposed (i) at a negative side rake angle between −5° and −30° and preferably between −5° and −20° and (ii) preferably at a negative back rake angle between −5° and −30° and preferably between −5° and −20°. The secondary dressing action of tool 21 is provided by linear dressing edge 61.

While it is preferred to dress or true using the present negative side rake angle in combination with a negative back rake angle, it is also possible to dress or true using the negative side rake angle in combination with a positive back rake angle ranging up to 15°.

The greatly improved dresser life with the present low negative rake angle and with the present lip angle of at least 90° over prior art utilizing either a positive rake with a lip angle of less than 90° or a negative rake significantly higher than that of the present invention, along with high clearance angles ordinarily at least about 30° is due to the rake face in the present invention being in compression while in the prior art it is under tension. Since the materials used for dressers are extremely hard and brittle, they are extremely weak in tension and strong in compression. Consequently chipping and rapid wear of the dresser occurs unless the rake surface is kept under compression during dressing.

Such gross chippage is a serious problem because with a chipped corner it is difficult to remove material from a wheel when dressing. Also, as the dressing tool is fed across and into the wheel surface, the spindle of the wheel deflects and the dresser tends merely to rub the wheel without abrading the surface. Also, a tool with chipped corners tends to dress inaccurately the wheel which can lead to poor workpiece finish and dimensioning.

Figure 5:
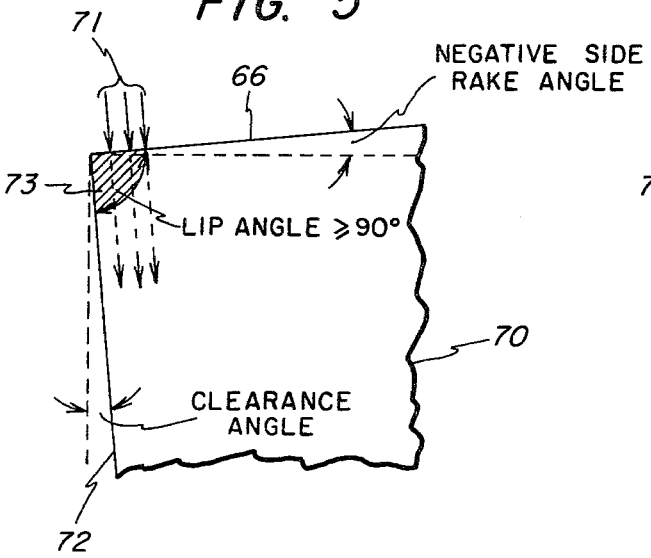
FIG. 5 is a schematic illustrating the present invention showing the present dressing tool 70 in side elevation having a negative side rake angle ranging from −5° to −35° and a lip angle equal to or greater than 90° in engagement with the periphery of a rotating grinding wheel (not shown), and the force acting on such dressing tool. Specifically.
Figure 6:
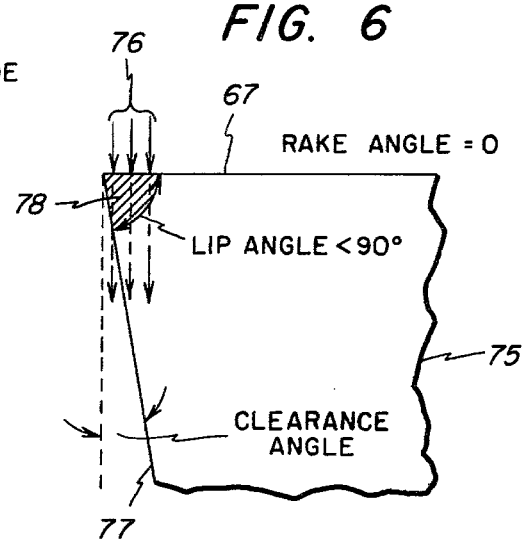
FIG. 6 is a schematic illustrating prior art showing a dressing tool 75 in side elevation having a zero rake angle and a lip angle less than 90° in engagement with the periphery of a rotating grinding wheel (not shown), and the force acting on such dressing tool. Specifically.
Figure 7:
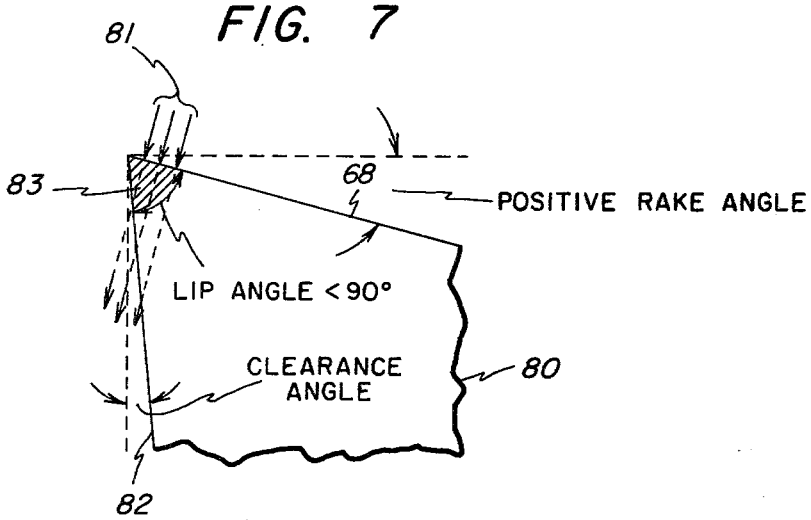
FIG. 7 is a schematic illustrating prior art showing a dressing tool 80 in side elevation having a positive rake angle and a lip angle less than 90° in engagement with the periphery of a rotating grinding wheel (not shown), and the large fraction of downward dressing force 81 acting on such dressing tool passing through the clearance face 82 and the shaded area 83 representing the portion of the tool in tension.

FIG. 5 illustrates the present invention and shows that the normal force 71 acting on the rake face 66 will be directed away from the clearance face 72 and thus keeps the tip of the dresser tool in compression. On the other hand, as illustrated by FIGS. 6 and 7, with a zero or positive side rake angle, the lip angle is always less than 90° and consequently, part of the normal force 76 and 81 on the rake faces 67 and 68 will be passing through the clearance faces 77 and 82 and subject the dresser tool tip to tension, and consequently, cause it to chip.

One particular advantage of the present invention is the ability of the dresser tool to dissipate heat away from the dresser tip. Specifically, in the present invention using a dresser tool with a negative side rake angle ranging from −5° to −35° and with a lip angle of at least or greater than 90° provides an area 73 available for dissipation of heat away from the dresser tip significantly larger than 78 and 83, i.e. that provided by using a dresser tool with a positive side rake angle and with a lip angle less than 90°. Since abrasives such as diamond and cubic boron nitride used in dressing, oxidize and graphitize at high temperatures, it is important to dissipate heat as rapidly as possible to maintain lower dresser temperature. Larger heat dissipation area at the dressing edge will facilitate such heat dissipation.

Another factor that improves the life of an abrasive compact dresser with the present low negative side rake over that with a positive side rake (i.e., wear on the clearance face) especially in critical applications, where the dresser edge is used as a gage (reference) for automatic dimensional control of the work material during grinding, is the adaptation of higher clearance angles. Clearance angle is defined as the angle between the dressing velocity vector relative to the grinding wheel and the clearance face of the tool. Unfortunately, a unilateral increase in the clearance angle, that results in a decrease in lip angle, will weaken the dresser tip and cause the dresser tip to crumble. With the present low negative rake dresser, it is possible to increase the clearance angle and still be able to maintain a lip angle of at least 90°. In contrast, with a positive rake dresser, the lip angle is already less than 90° and any increase in the clearange angle will further decrease the lip angle and consequently the strength of the dresser tip. Also with very low clearance angle (about 3° to 5°) as one encounters with a high positive rake dresser, small error in either grinding the proper clearance angle or in mounting the dresser on the grinding machine, that effectively reduces the clearance angle further by one or two degrees, will increase the flank wear length considerably. With higher clearance angles as with the present low negative rake dresser, the effect of such errors will be minimized. Of course not much is gained by increasing the clearance angle above 15° except to reduce the strength of the dresser tip.

In the following the effect of varying the clearance angle with a corresponding adjustment in the rake angle to maintain lip angle the same, on the flank wear length, k (explained in connection with FIG. 8) at any arbitrary infeed depth, d of the dresser is disclosed.

Since choice of the clearance angle is more critical with a positive rake dresser than with a low negative rake dresser, a +15° positive rake, 5° clearance angle dresser 86 will be used as a standard for comparison. Since the concern here is only on the flank wear on the clearance face 88, this discussion applies to both positive and negative rake dressers.

Figure 8:
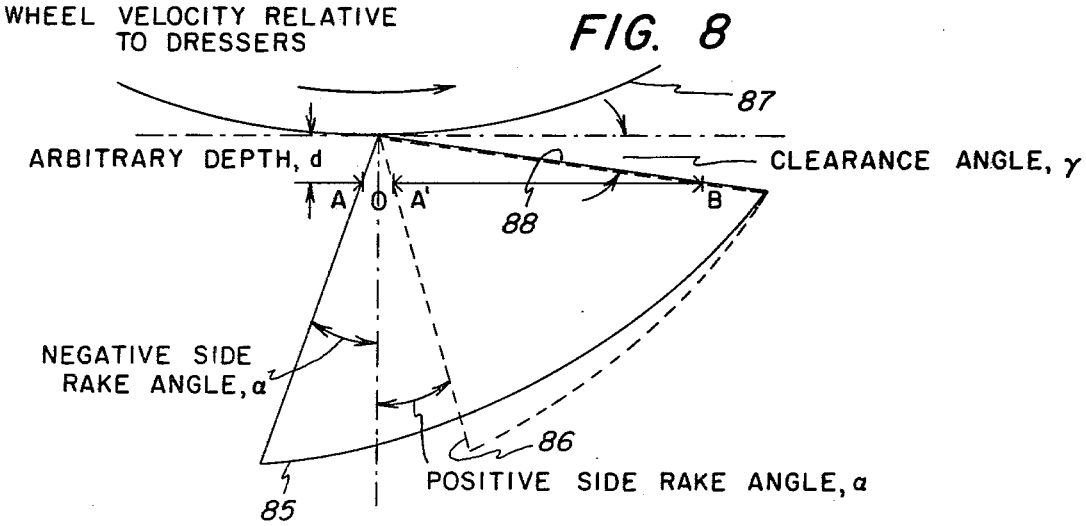
FIG. 8 is a schematic showing a comparison in elevation of the present dressing tool 85 in solid line, and superimposed thereon, a prior art dressing tool 86 shown in dotted line having a positive rake angle with both dressers in engagement with the periphery of rotating grinding wheel 87 at the same clearance angle.
Figure 9:
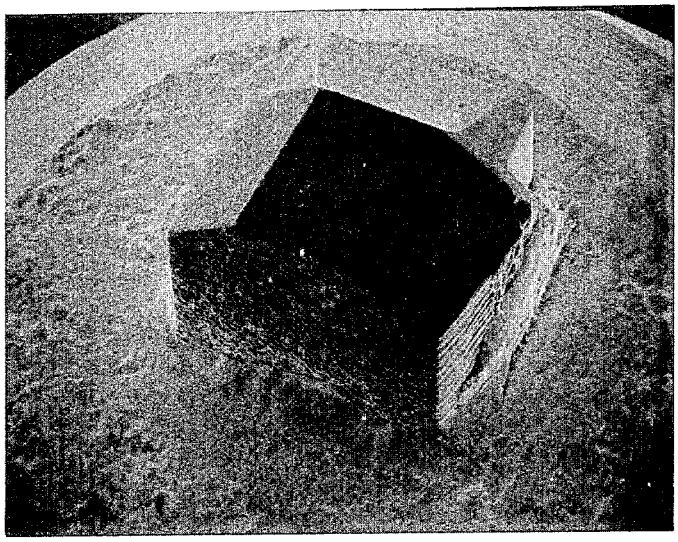
FIG. 9 is a photomicrograph magnified 18X showing the dressing tool of the present invention and illustrates a composite compact having the present configuration mounted on one end of a shank. In the composite compact of FIG. 9, the dark grey portion comprises the present polycrystalline diamond compact and the remaining portion is a supporting substrate of cemented tungsten carbide.

In FIG. 8, AB=flank wear length, k, for dresser 85 with the present negative side rake angle and A'B=-flank wear length, k, for dresser 86 with positive side rake angle.

Consider the effect of changing the clearance angle $\gamma$ with a corresponding change in the rake angle, $\alpha$ to maintain the lip angle constant, on the flank wear length at any arbitrary infeed depth, d.

For a negative rake dresser, $$\text{the flank wear length, } k=(OB+OA)=d\,[\tan(90-\gamma)+\tan\alpha]$$

For a positive rake dresser, $$\text{the flank wear length } k=A'B=OB-OA'=d\,[\tan(90-\gamma)-\tan\alpha]$$

This equation can be generalized as $$\text{flank wear length, } k=d[\tan(90-\gamma)\pm\tan\alpha]$$

+ for negative rakes
− for positive rakes

Using the above equation for various values of $\gamma$ and $\alpha$, flank wear length, k and percentage increase/decrease in flank wear length over the standard dresser (rake angle +15 degrees and clearance angle +5 degrees) are given in Table I.

As can be seen from the Table I, increasing the clearance angle from 5 to 10 degrees will decrease the flank wear length by about 50%. Additional increases in steps of 5 degrees will decrease the percentage wear length by 33% and 25%. The most important fact is the effect of any inaccuracy (decreasing the clearance angle) in either grinding the clearance face or mounting the dresser on the grinding machine by couple of degrees of a 5 degrees clearance dresser. When the clearance angle is reduced by two degrees to say 3 degrees the percentage wear length can be seen to increase by a huge 68%. This gives some appreciation of the effect of small clearance angles on the wear land length. It can also be noted from Table I, that although the wear land length decreases with increase in clearance angle, each additional increase in clearance angle will result in less than proportionate decrease in wear land length. High clearance angles decrease the lip angle and weaken the tool dresser's tip, unless compensated by a decrease in rake angle. Rake angles more negative than −30 degrees will reduce the efficiency of material removal and require normal thrust at least twice the cutting force. An optimum clearance angle will be a compromise between the above two conflicting requirements. Based on experimental work and past experience, clearance angles greater than 15 degrees are not recommended and clearance angle between 7 and 12 degrees are preferred. To keep the rake face in compression (lip angle of at least 90 degrees) this leads to a rake angle of say −7 to −12 degrees or roughly −5 to −15 degrees.

TABLE I

| Se. No. | Rake angle, $\alpha$ | Clearance angle, $\gamma$ | Flankwear length, k | % increase or decrease in flank wear length | Remarks |
|---|---|---|---|---|---|
| 1 | 15 | 5 | 11.16d | — | Standard |
| 2 | 10 | 10 | 5.5d | −49.2 | % decrease in k |
| 3 | 5 | 15 | 3.65d | −32.65 | % decrease in k |
| 4 | 0 | 20 | 2.75d | −24.6 | % decrease in k |
| 5 | 16 | 4 | 14.0d | +25.5 | % increase in k |
| 6 | 17 | 3 | 18.7d | +67.5 | % increase in k |
| 7 | 6 | 14 | 3.91d | — | — |
| 8 | 7 | 13 | 4.208d | — | — |

The novel dressing tool of the present invention has a dressing edge consisting essentially of a side dressing edge angle ranging between 30° and 75° wherein the side dressing edge is at least about 0.5 millimeter in length, an end dressing edge angle ranging between 5° and 30° wherein the end dressing edge is at least about 0.5 millimeter in length, and a straight secondary dressing edge of at least about one millimeter in length joining the side and end dressing edges, said dressing edge having a lip angle ranging from 90° to 120°, said dressing tool being comprised of a polycrystalline compact mounted at one end of a shank, said compact being comprised of bonded crystals wherein the crystals or crystalline particles are selected from the group consisting of diamond, cubic and wurtzite forms of boron nitride, and mixtures thereof. The volume of the crystals in the compact is at least about 50% of the total volume of the compact.

In the present polycrystalline compact, the crystals or crystalline particles are bonded together either (1) in a self-bonded relationship, or (2) by means of bonding medium disposed between the crystals, or (3) by means of some combination of (1) and (2). U.S. Pat. No. 3,136,615; U.S. Pat. No. 3,141,746 and U.S. Pat. No. 3,233,988 disclose methods of preparing polycrystalline compacts having the composition and bonding which makes them useful herein. (The disclosures of these patents are hereby incorporated by reference herein.)

A composite compact is defined as a polycrystalline compact bonded to a supporting substrate material such as cemented metal carbide, for example a cemented tungsten carbide. A bond to the substrate can be formed either during or subsequent to the formation of the compact. U.S. Pat. No. 3,745,623; U.S. Pat. No. 3,743,489 and U.S. Pat. No. 3,767,371 disclose methods of preparing composite compacts which are useful in the present invention. (The disclosures of these patents are hereby incorporated by reference herein.)

A composite compact is preferred for forming the dressing tool of the present invention because of the support, and consequently, longer tool life, provided by the substrate. Preferably, the polycrystalline compact is in the form of a layer which is preferably supported by a substrate in the form of a layer, which is coextensive with the polycrystalline compact and bonded thereto. In a preferred embodiment, the present dressing tool is mounted on one end of a shank.

This invention has application to all grinding wheel bond systems such as metal, resin, vitreous, rubber, shellac, silicate, and oxychloride. The abrasive of the grinding wheel may be selected from any of the conventional abrasives such as diamond, cubic boron nitride, aluminum oxide, silicon carbide, etc.

Dressing tests were conducted on a DoA11 surface grinding machine to evaluate the performance of the present dresser.

Table II shows the dresser used in each test. The dressers of Tests 1 and 2 were that of the present invention and each had the configuration shown in FIGS. 4 and 5. Specifically, the dresser of Tests 1 and 2 was comprised of a composite compact mounted at one end of a shank. The composite compact was comprised of a layer of a polycrystalline diamond compact supported by a substrate layer of cemented tungsten carbide. The polycrystalline compact was composed of diamond crystals bonded together by a bonding medium wherein the crystals ranged in size from about 100 microns to about 150 microns and wherein the crystals were present in at least about 80% by volume of the total volume of the compact. The substrate layer was coextensive with and bonded to the polycrystalline diamond compact layer. In Tests 1 and 2, the dressing edge was composed of a side dressing edge of 0.5 millimeter in length, and an end dressing edge of 0.5 millimeter in length and a straight secondary edge 1.5 millimeters in length which joined the side and end dressing edges. Also, in Tests 1 and 2, the side dressing edge angle was 65 degrees and the end dressing edge angle was 25 degrees but the lip angle in the dresser of Test 1 was 100 degrees whereas in the dresser of Test 2 it was 90°.

The dressers used in Tests 3 and 4 were substantially the same as those of Tests 1 and 2 except that the dresser of Test 3 had a lip angle of 70° and the dresser of Test 4 had a lip angle of 60°. In Test 5 the dresser was composed of a single point natural octahedral diamond mounted at one end of a shank.

Table II gives the side rake angle and the clearance angle of each test.

TABLE II

| Test | Dresser | Side Rake Angle | Clearance Angle |
|---|---|---|---|
| 1 | Composite Diamond Compact of present invention lip angle 100° | −15° | +5° |
| 2 | Composite Diamond Compact of present invention lip angle 90° | −15° | +15° |
| 3 | Composite Diamond Compact lip angle 70° | +15° | +5° |
| 4 | Composite Diamond Compact lip angle 60° | +15° | +15° |
| 5 | Single Point Natural Octahedral Diamond lip angle 70° | ≈−50° | ≈50° |

The dressing conditions in each test of Table II were as follows:

| | |
|---|---|
| Grinding wheel: | 32A 60 K 5VBE (60 grit vitrified bonded white aluminum oxide wheel) |
| Wheel speed: | 6000 sfpm |
| Downfeed/pass: | 0.001 in/pass |
| Cross feed: | 2 fpm |
| Number of dressing passes: | 100 |

At the end of each test of Table II, the dressers were examined in a Scanning Electron Microscope to evaluate wear on the dresser.

No significant wear was observed on the rake face of the dressers of Tests 1 and 2 which illustrate the present invention. On the other hand, considerable wear and significant chipping were observed on the dressers of Tests 3 and 4. The tip of the dresser of Test 5 also wore significantly with the result the rake face was advanced further leaving a large wear on the clearance face. The gross chipping of the dressers of Tests 3 and 4 was due to the fact that the dresser edge in these tests was in tension (lip angle <90°) and consequently the dresser edge is amenable to fracture.

Wear on the clearance face of the dressers of Tests 1 and 2 were found to be about 70% less than that of the dressers of Tests 3, 4 and 5. Considerable chipping was observed on the clearance face of the dressers of Tests 3 and 4 while no chipping was observed on the dressers of Tests 1 and 2.

The tests of Table II show that significant improvement in wear resistance is provided by the present invention. Also chipping of the dressers of Tests 3 and 4 will result in an uneven dressing edge and cannot be used for long as a gage surface for controlling the dimensions of the ground surface in internal grinding.

In copending U.S. patent application Ser. No. 078,954 entitled "Method for Trueing and Dressing a Grinding Wheel and Dressig Tool Therefor" filed of even date herewith in the name of Rangachary Komanduri, and assigned to the assignee hereof, and which by reference is incorporated herein, the disclosed process comprises providing a dressing tool having a dressing edge consisting essentially of a side dressing edge angle ranging between 30° and 75° wherein the side dressing edge is at least about 0.5 millimeter in length and an end dressing edge angle ranging between 5° and 30° wherein the end dressing edge is at least about 0.5 millimeter in length and intersects the side dressing edge, said dressing edge having a lip angle ranging from 90° to 120°, and engaging the periphery of a rotating grinding wheel with said dressing tool at a negative side rake angle ranging from −5° to −35°.

What is claimed is:

1. A tool for trueing and dressing a grinding wheel at a negative rake angle, having a dressing edge consisting essentially of a side dressing edge angle ranging between 30° and 75° wherein the side dressing edge is at least about 0.5 millimeter in length, an end dressing edge angle ranging between 5° and 30° wherein the end dressing edge is at least about 0.5 millimeter in length, and a straight secondary dressing edge of at least about one millimeter in length joining said side and end dressing edges, said dressing edge having a lip angle ranging from 90° to 120°, and said dressing tool comprising a tool shank and a polycrystalline compact mounted at one end of said shank, said compact comprising bonded crystals selected from the group consisting of diamond, cubic and wurtzite forms of boron nitride and mixtures thereof.

2. The dressing tool according to claim 1 wherein said crystals are bonded directly to each other.

3. The dressing tool according to claim 1 wherein said crystals are bonded by means of a bonding medium.

4. The dressing tool according to claim 1 wherein said compact is supported by a substrate coextensive with and bonded to said compact.

5. The dressing tool according to claim 4 wherein said substrate is cemented tungsten carbide.

* * * * *